US007401685B2

(12) United States Patent
Roschier et al.

(10) Patent No.: US 7,401,685 B2
(45) Date of Patent: Jul. 22, 2008

(54) ELEVATOR TESTING SYSTEM

(75) Inventors: Nils-Robert Roschier, Vantaa (FI); Olof Ahlskog, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/785,013

(22) Filed: Apr. 13, 2007

(65) Prior Publication Data

US 2007/0284195 A1 Dec. 13, 2007

Related U.S. Application Data

(63) Continuation of application No. PCT/FI2005/000459, filed on Oct. 26, 2005.

(30) Foreign Application Priority Data

Nov. 1, 2004 (FI) ..... 20041403

(51) Int. Cl.
*B66B 1/34* (2006.01)

(52) U.S. Cl. ..... 187/391; 187/277

(58) Field of Classification Search ..... 187/247, 187/277, 288, 289, 293, 316, 317, 313, 391–396; 49/26, 120; 361/54, 56, 57, 79, 86, 87; 198/330, 198/339.1–341.03, 341.09, 502.1, 502.4, 198/510.1

See application file for complete search history.

(56) References Cited

U.S. PATENT DOCUMENTS

| | | | | |
|---|---|---|---|---|
| 3,765,664 | A | 10/1973 | Ojima et al. | |
| 5,107,964 | A * | 4/1992 | Coste et al. | 187/280 |
| 5,392,879 | A * | 2/1995 | Boyce et al. | 187/393 |
| 5,487,448 | A | 1/1996 | Schollkopf et al. | |
| 5,549,179 | A * | 8/1996 | Herkel et al. | 187/298 |
| 6,056,088 | A * | 5/2000 | Gerstenkorn | 187/390 |
| 6,446,760 | B1 | 9/2002 | Lisi et al. | |

* cited by examiner

*Primary Examiner*—Jonathan Salata
(74) *Attorney, Agent, or Firm*—Birch, Stewart, Kolasch & Birch, LLP

(57) ABSTRACT

The invention concerns a method and a system for ensuring the operation of the safety circuit of an elevator or escalator, said safety circuit containing safety contacts (10, 12, 14) connected in series with a contactor (16). In the method, the largest bypass current coming to the contactor in a fault situation is defined, a testing device (202) is connected in series with the safety circuit, said testing device containing at least one resistor (26), which is used to produce a desired test current that is larger than the largest bypass current, and the neutral point (18) of the safety circuit is shifted if the contactor (16) remains energized by the aforesaid test current.

8 Claims, 3 Drawing Sheets

ELEVATOR TESTING SYSTEM

This application is a Continuation of copending PCT International Application No. PCT/FI2005/000459 filed on Oct 26, 2005, which designated the United States, and on which priority is claimed under 35 U.S.C. § 120. This application also claims priority under 35 U.S.C. § 119(a) on Patent Application No(s).20041403 filed in Finland on Nov. 1, 2004. The entire contents of each of the above documents is hereby incorporated by reference.

FIELD OF THE INVENTION

The present invention relates to elevator systems. In particular, the present invention concerns a method and a system for testing the operation of a safety circuit especially in already existing elevator systems so as to achieve the required safety level.

BACKGROUND OF THE INVENTION

It is of primary importance to the operation of an elevator system that the elevator system should function faultlessly and above all in a predictable manner. Especially in situations where various systems, e.g. remote monitoring systems, are connected to the safety circuits of already existing elevators, it is necessary to make sure that the operation of the safety circuits of the elevator system will meet the required safety standard even after the connection of said systems.

Elevator systems employ various monitoring devices and methods to ensure the safety of the elevator. One of these is the so-called electric safety circuit. The safety circuit consists of safety device contactors connected in series. If any one of the safety devices breaks the safety circuit, then the elevator will stop or will not start moving. The safety circuit monitors e.g. the car doors, hoistway doors, locks, etc. If e.g. the elevator car doors are open, then the safety circuit is open.

Figure 1A:
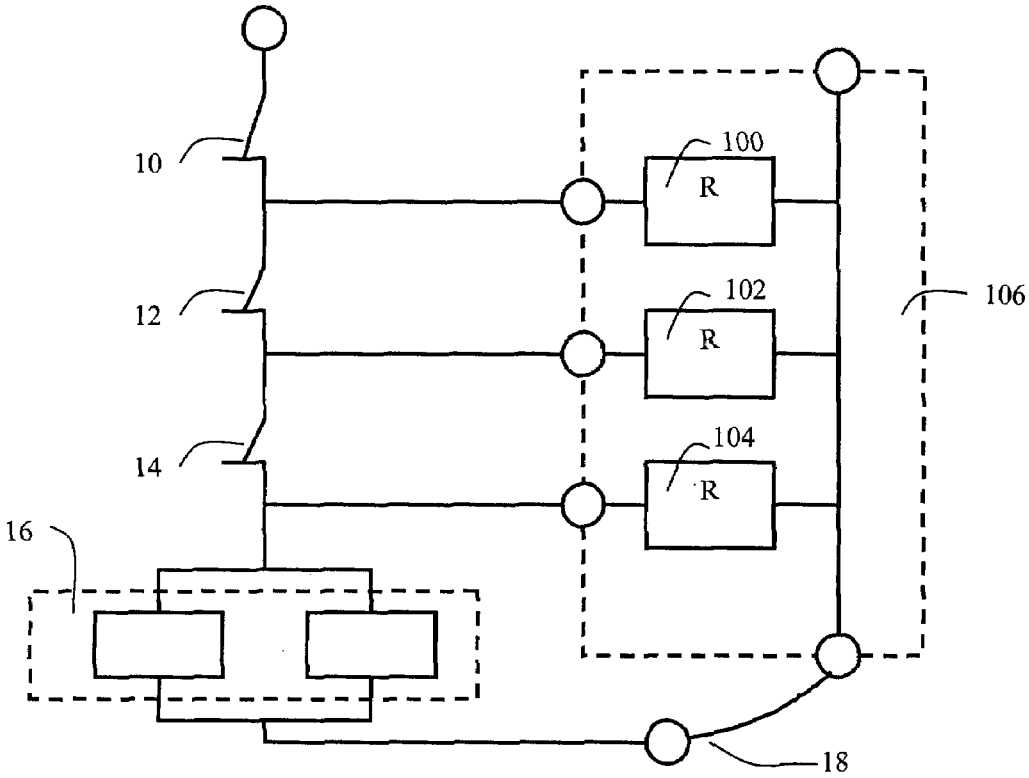
Figure 1B:
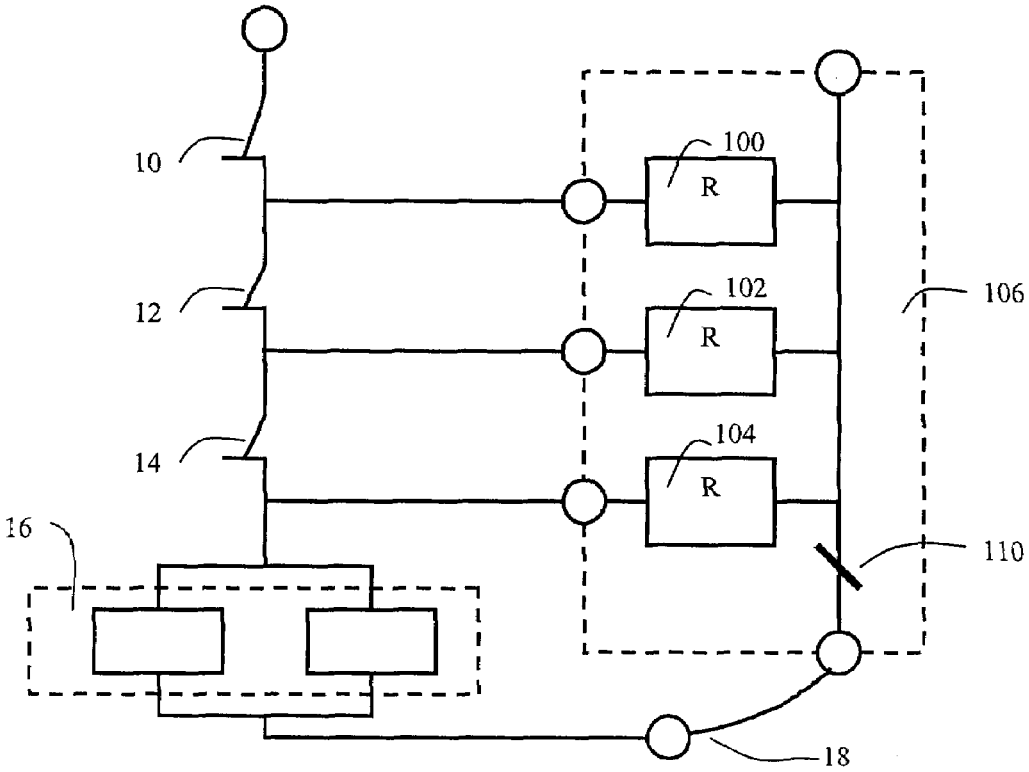

FIG. 1*a* presents an example of the structure of a safety circuit. In FIG. 1*a*, there are three safety contactors 10, 12, 14 connected in series. The safety circuit is connected to main contactors 16 and a monitoring card 106, which is presented as a highly simplified resistance circuit. The main contactors 16 and the monitoring card 106 are connected to common ground 18 (neutral ground). The worst fault situation that may be caused by the monitoring card is illustrated in FIG. 1*b*, where the neutral conductor connected to neutral ground 18 is broken (110). In this situation it is possible that the fault causes a current to flow through the main contactors that will be sufficient to keep the main contactors energized "while the safety circuit is open".

Figure 1C:
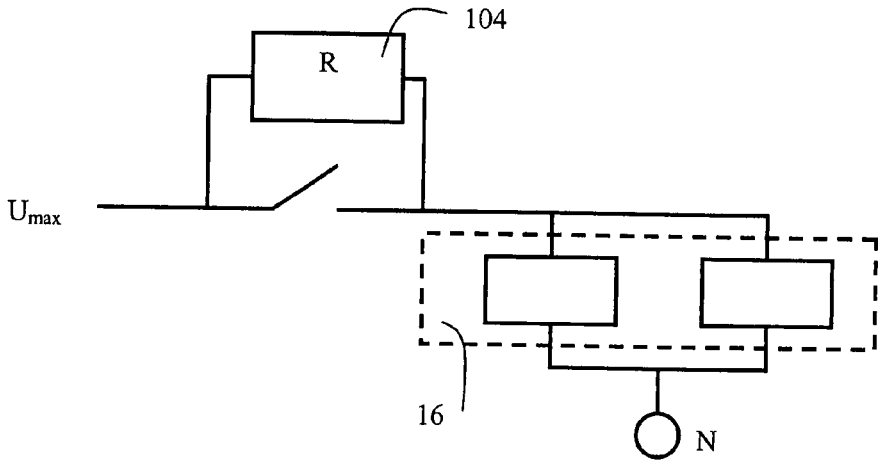

Let us assume that each one of the resistances 100, 102, 104 has a magnitude of 300 k•. In this case, the smallest overbridging resistance has a magnitude of 450 k•. In other words, two parallel 300k• resistances are in series with a third 300 k• resistance. FIG. 1*c* presents a circuit corresponding to the circuit in FIG. 1*b*. The resistance 112 has a magnitude of 450 k•. If the safety circuit voltage ($U_{max}$) is 230Vac, then the largest possible fault current will be about 0.5 A.

On the basis of the above-mentioned factors, it is possible that the fault current produced in a fault situation will be sufficient to keep the main contactors energized. If the main contactors remain energized even if the safety circuit is open, then the elevator does not meet the safety regulations.

Figure 1D:
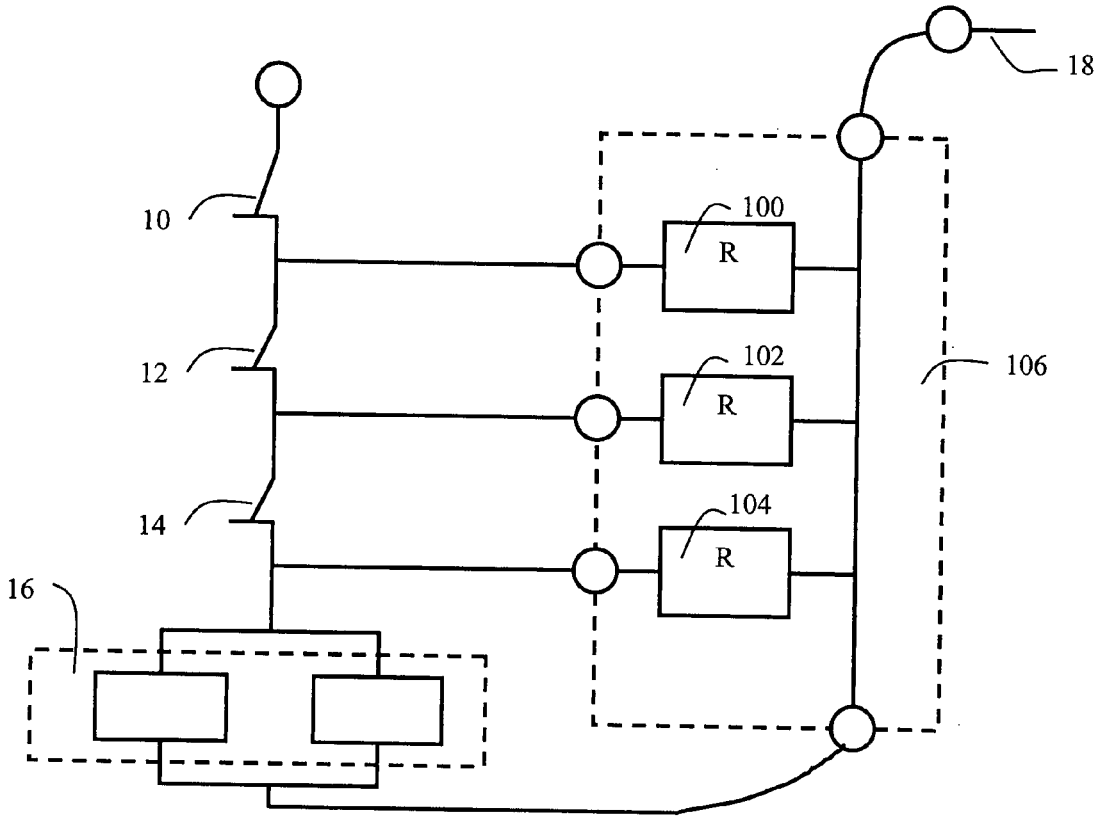

Elevator safety regulations recommend that the neutral ground of the safety circuit should be connected via an analyzing card, such as e.g. a remote monitoring card, to neutral ground. The recommendations given by elevator regulations define the safest way of implementing the connection of an analyzing card to the safety circuits. If a deviation from this is opted for, then a corresponding safety level has to be proved via a risk analysis. The normal recommendation for a circuit to avoid a bypass current situation is to take the return current from the main contactors via the neutral conductor of the analyzing card to neutral ground, thus making it impossible for the safety circuit to be incorrectly bypassed in a fault situation. Such a circuit is presented in FIG. 1*d*. However, in many existing elevator control systems it is often difficult to change the connections afterwards.

OBJECT OF THE INVENTION

The object of the present invention is to disclose a method and a system for ensuring the safety of the safety circuit of an elevator system when a monitoring card is connected to the safety circuit of the elevator system.

BRIEF DESCRIPTION OF THE INVENTION

As for the features of the present invention, reference is made to the claims.

The method of the invention is characterized by what is disclosed in the characterization part of claim 1. The system of the invention is characterized by what is disclosed in the characterization part of claim 5. Other embodiments of the invention are characterized by what is disclosed in the other claims. Inventive embodiments are also presented in the description part and drawings of the present application. The inventive content disclosed in the application can also be defined in other ways than is done in the claims below.

The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

The invention concerns a method for ensuring the operation of the safety circuit of an elevator or escalator, said safety circuit containing safety contacts connected in series with a contactor. In the method, the largest bypass current coming to the contactor in a fault situation is defined, a testing device is connected in series with the safety circuit, said testing device containing at least one resistor, which is used to produce a desired test current that is larger than the largest bypass current, and the neutral point of the safety circuit is shifted if the contactor remains energized by the aforesaid test current.

In an embodiment of the invention, the test current is generated while the elevator or escalator is moving.

In an embodiment of the invention, in the case of parallel safety circuits, each parallel circuit is tested separately.

In an embodiment of the invention, the testing device is connected to a point in the safety circuit that is located closest to the contactor.

The invention also relates to a system for ensuring the operation of the safety circuit of an elevator or escalator, said safety circuit comprising safety contacts connected in series with a contactor. The system further comprises a testing device connected in series with the safety circuit and containing at least one resistor, which is used to produce a desired test current to the contactor, said test current being larger than the largest current coming to the contactor in a fault situation, and means for shifting the neutral point of the safety circuit in a fault situation where the contactor remains energized by the aforesaid test current.

In an embodiment of the invention, the testing device has been arranged to produce a test current while the elevator or escalator is moving.

In an embodiment of the invention, the testing device has been arranged to test, in the case of parallel safety circuits, each parallel circuit separately.

In an embodiment of the invention, the testing device is connected to a point in the safety circuit that is located closest to the contactor.

The present invention has several advantages as compared to prior-art solutions. The invention makes it possible to determine whether it is necessary to shift the neutral point or not. By applying the invention, it is easy to test the elevator safety circuits in different operational states of the elevator, such as when the elevator car is moving.

By following the procedure disclosed by the invention, a sufficient elevator safety level is ensured without passing the neutral conductor of the main contactors via the analyzing card to the neutral point.

LIST OF FIGURES

Figure 2:
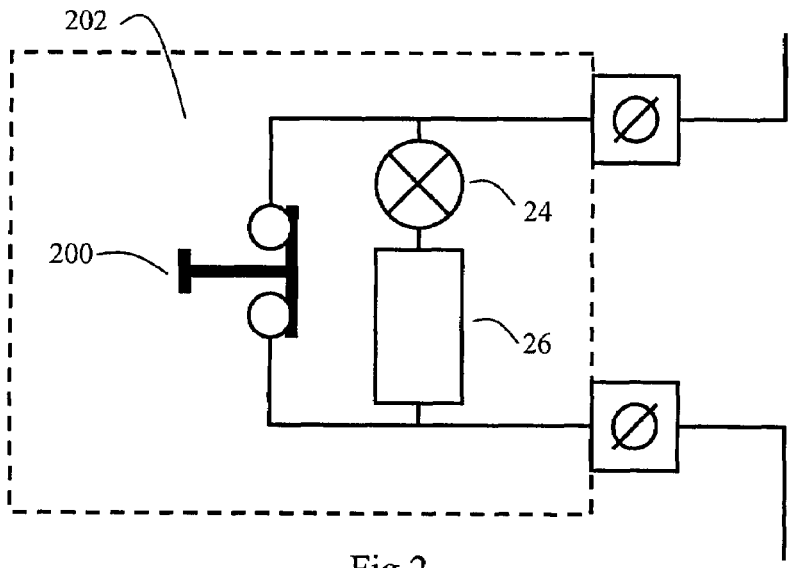
Figure 3:
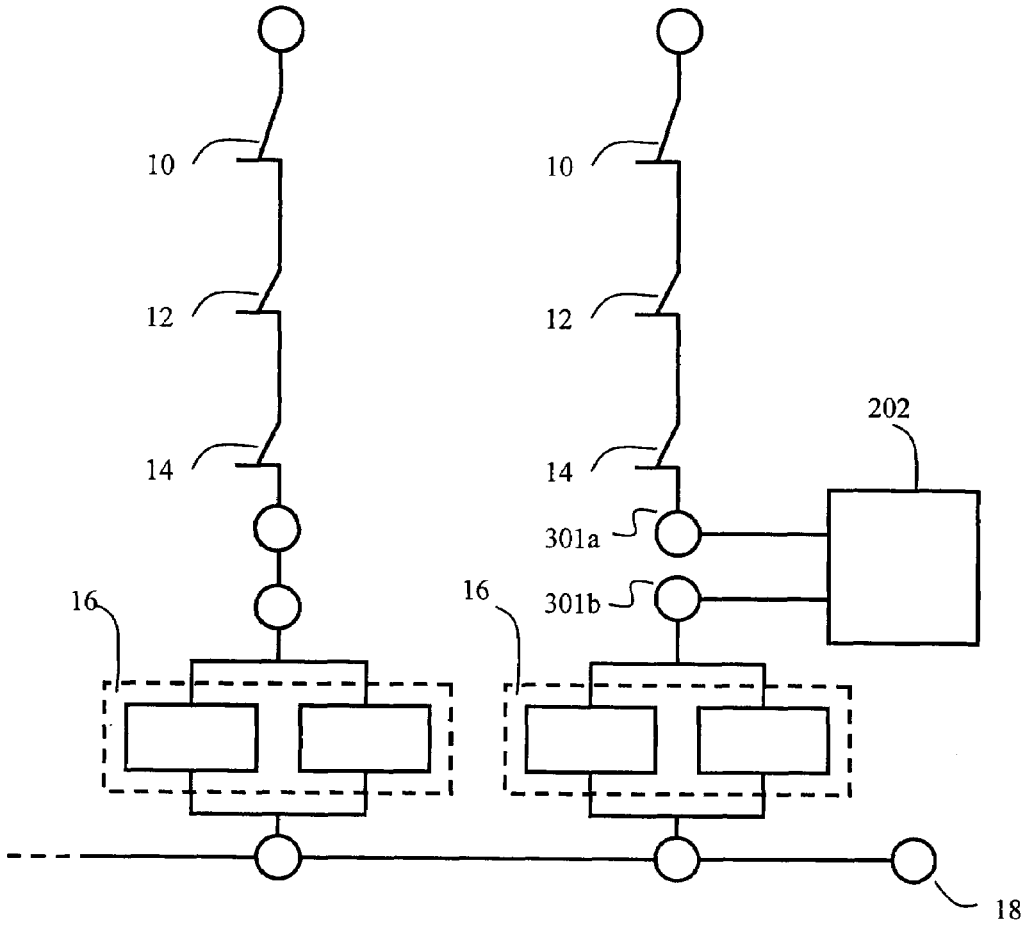

In the following, the invention will be described in detail with reference to embodiment examples, wherein FIGS. 1*a*, 1*b*, 1*c* and 1*d* present a block diagram of a prior-art safety circuit, FIG. 2 presents a block diagram of a testing device according to the invention ensuring the safety of the safety circuit, and FIG. 3 presents a block diagram of a safety circuit wherein the point of connection of the testing device is indicated.

DETAILED DESCRIPTION OF THE INVENTION

In the following, the invention will be described in detail with reference to FIGS. 2 and 3. FIG. 2 presents a block diagram of a testing device according to the invention ensuring the safety of a safety circuit, and FIG. 3 presents a block diagram of a branched safety circuit, showing the points to which the testing device is connected.

The testing device 202 presented in FIG. 2 comprises a switch 200, a lamp 24 and a resistor 26. The switch 200 serves to open the safety circuit, the resistor 26 to determine the value of the test current and the lamp, e.g. a LED lamp (LED, Light Emitting Diode), to detect the test current. The testing device 202 is connected in series with the safety circuit to a point located closest to the main contactors, in other words to point 301*a* and 301*b* as shown in FIG. 3. If the safety circuit comprises several branches, then each branch is tested separately.

In the actual testing of the safety circuit, the elevator or escalator is operated while the switch 200 of the testing device 202 is closed. When the switch 200 is opened, the main contactors 16 should open, whereupon the elevator should stop immediately. The lamp 24, e.g. a LED light (LED, Light Emitting Diode) confirms that a test current flowed through the testing device 202 and that the test current is actually connected to the safety circuit. Upon completion of the testing of the safety circuit, the testing device 202 is removed and the original safety circuit connections are restored.

If, after the switch 200 has been opened, the main contactors 16 remain energized and the elevator does not stop, then the testing device 202 has revealed a situation where the safety circuit connection does not pass the test. As a consequence of the detection of such a situation, the neutral point 18 has to be shifted so that it passes via the analyzing card 106 (see FIG. 1*d*).

With a safety circuit voltage of 230 VAC, the maximal spillover current is about 0.5 mA in the case illustrated in FIG. 1*b*. For the operation of the safety circuit to be fully acceptable, the test current of the main contactors 16 has to be greater than the maximal spillover current, e.g. three times as large when a safety coefficient of 3 is used, i.e. about 1.5 mA in the case illustrated in FIG. 1*b*. To define an acceptable test current and/or safety coefficient, various risk analysis methods can be utilized. This ensures that the main contactors 16 will not remain connected. If a coefficient of three is used, then the testing resistance 26 of the testing device 202 has a maximum value of 150 kΩ in the case presented as an example.

The operation of the safety circuit has to be ensured separately for either direction of motion of the elevator, because the safety circuit may control different devices depending on the direction of motion of the elevator.

The above-described method of testing the safety circuit is designed for use especially in old elevators. In newer elevators, the elevator safety circuit is typically constructed in a manner that takes into account the aforesaid safety circuit situation so that the neutral ground is passed via the analyzing cards.

One of the objectives of the invention is to avoid unnecessary shifting of the neutral point. On the basis of the disclosed testing method, it is possible to determine whether the neutral point needs to be shifted. At the same time, unnecessary shifts of the neutral point are avoided.

Another objective of the invention is to provide a response to the heightened level of requirements regarding the safety systems of existing elevators. In response to the higher requirement level, the testing arrangement of the invention is used, wherein the existence of an excessive holding current in the safety circuit is established to be impossible.

It is obvious to the person skilled in the art that the invention is not limited to the embodiments described above, wherein the invention has been described by way of example, but that many variations and different embodiments of the invention are possible within the scope of the inventive concept defined in the claims presented below.

The invention claimed is:

1. A method for ensuring the operation of the safety circuit of an elevator or escalator, said safety circuit containing safety contacts (10,12,14) connected in series with a contactor (16), characterized in that the method comprises the steps of:

defining the largest bypass current coming to the contactor in a fault situation;

connecting a testing device in series with the safety circuit, said testing device containing at least one resistor, which is used to produce a desired test current that is larger than the largest bypass current; and shifting the neutral point (18) of the safety circuit if the contactor remains energized by the aforesaid test current.

2. A method according to claim 1, characterized in that the method further comprises the step of:

producing a test current while the elevator or escalator is moving.

3. A method according to claim 1, characterized in that the method further comprises the step of:

testing each circuit in parallel safety circuits separately.

4. A method according to claim 1, characterized in that the method further comprises the step of:

connecting the testing device to a point (301*a*, 301*b* ) in the safety circuit that is located closest to the contactor (16).

5. A system for ensuring the operation of the safety circuit of an elevator or escalator, said safety circuit comprising safety contacts (10,12,14) connected in series with a contactor (16), characterized in that the system further comprises:

a testing device (202) connected in series with the safety circuit and containing at least one resistor (26), which is used to produce a desired test current to the contactor (16), said test current being larger than the largest current coming to the contactor in a fault situation; and means for shifting the neutral point (18) of the safety circuit in a fault situation where the contactor remains energized by the aforesaid test current.

6. A system according to claim 5, characterized in that the testing device (202) has been arranged to produce a test current while the elevator or escalator is moving.

7. A system according to claim 5, characterized in that the testing device (202) has been arranged to test each parallel circuit in parallel safety circuits separately.

8. A system according to claim 5, characterized in that the testing device is connected to a point (301*a*, 301*b*) in the safety circuit that is located closest to the contactor (16).

* * * * *